US005604189A

United States Patent [19]

Zhang et al.

[11] Patent Number: 5,604,189

[45] Date of Patent: Feb. 18, 1997

[54] COMPOSITION FOR CLEANING AND WETTING CONTACT LENSES

[76] Inventors: Hong J. Zhang, B2 Colonial Dr. #3, Andover, Mass. 01810; Edward J. Ellis, 9 Hampton Ct., Lynnfield, Mass. 01940; Stanley J. Wrobel, 8 Eastman Rd., Andover, Mass. 01810; Chimpiramma Potini, 29 Copley Dr., Methuen, Mass. 01844

[21] Appl. No.: 468,603

[22] Filed: Jun. 6, 1995

Related U.S. Application Data

[62] Division of Ser. No. 350,749, Dec. 7, 1994, abandoned, which is a continuation of Ser. No. 80,425, Jun. 18, 1993, abandoned.

[51] Int. Cl.[6] ..... C11D 3/48; C11D 1/00

[52] U.S. Cl. ..... 510/112; 510/365; 510/406; 510/407; 510/413; 514/839

[58] Field of Search ..... 514/839; 510/112, 510/365, 406, 407, 413

[56] References Cited

U.S. PATENT DOCUMENTS

| | | | |
|---|---|---|---|
| 3,882,036 | 5/1975 | Krezanoski | 252/106 |
| 3,954,644 | 5/1976 | Krezanoski | 252/106 |
| 4,046,706 | 6/1977 | Krezanoski | 510/112 |
| 4,048,122 | 9/1977 | Sibley | 252/541 |
| 4,126,587 | 11/1978 | Sibley | 252/541 |
| 4,354,952 | 10/1982 | Reidhammer et al. | 510/112 |
| 4,409,205 | 10/1983 | Shively | 424/78 |
| 4,504,405 | 3/1985 | Howes | 252/106 |
| 4,613,380 | 9/1986 | Chen | 134/30 |
| 4,820,352 | 4/1989 | Riedhammer | 134/30 |
| 4,836,986 | 6/1989 | Ogunbiyi et al. | 422/28 |
| 5,141,665 | 8/1992 | Sherman | 252/106 |
| 5,422,029 | 6/1995 | Potini et al. | 510/112 |

FOREIGN PATENT DOCUMENTS

| | | | |
|---|---|---|---|
| 63-59960 | 3/1988 | Japan | A61L 2/18 |
| 63-159821 | 7/1988 | Japan | G02C 13/00 |
| 1340518 | 12/1973 | United Kingdom | C08B 21/26 |
| 1340516 | 12/1973 | United Kingdom | C08B 21/26 |
| 89/11878 | 12/1989 | WIPO . | |

OTHER PUBLICATIONS

Chemical Abstracts, 80:100207t (1974).
Chemical Abstracts, 80:100208u (1974).
Chemical Abstracts, 110:199267k (1989).
Chemical Abstracts, 111:45334p (1989).
Article titled "Emulsification" (BASF Trade Literature).
Article titled "Typical Properties of Block Copolymer Surfactants" (BASF Literature).
Article titled "Classification of Surface–Active Agents by HLB" by William C. Griffin, Atlas Powder Company, Wilmington, Del., J. Soc. Cosm. Chem., 1949, pp. 311–327.

*Primary Examiner*—Ponnathapura Achutamurthy
*Attorney, Agent, or Firm*—Edward W. Black; John E. Thomas

[57] ABSTRACT

A composition for cleaning and wetting contact lenses comprises a polyethyleneoxide-containing material having a hydrophile-lipophile balance (HLB) of at least about 18, a surface active agent having cleaning activity for contact lens deposits, and a wetting agent.

7 Claims, No Drawings

COMPOSITION FOR CLEANING AND WETTING CONTACT LENSES

This is a division of application Ser. No. 08/350,749 filed on Dec. 7, 1994, now abandoned which is a continuation of Ser. No. 08/080,425, filed on Jun. 18, 1993 (now abandoned).

BACKGROUND OF THE INVENTION

This invention relates to a composition for cleaning and wetting contact lenses which comprises a polyethyleneoxide-containing material having a hydrophile-lipophile balance (HLB) of at least about 18, a surface active agent having cleaning activity for contact lens deposits, and a wetting agent.

A care regimen for contact lenses involves various functions, such as regularly cleaning the lens with a contact lens solution containing a surface active agent as a primary cleaning agent. Rinsing of the contact lens is generally required following cleaning to remove loosened debris. Additionally, the regimen may include treatment to disinfect the lens, treatment to render the lens surface more wettable prior to insertion in the eye, or treatment to condition (e.g., lubricate or cushion) the lens surface so that the lens is more comfortable in the eye. As a further example, a contact lens wearer may need to rewet the lens during wear by administering directly in the eye a solution commonly referred to as rewetting drops.

Separate solutions may be provided for the individual savants of the care regimen. For convenience purposes, multipurpose contact lens solutions have gained popularity, i.e., solutions which can be used for several segments of the care regimen.

As an example, multipurpose contact lens solutions which can be used for cleaning, storage and conditioning of contact lenses have been suggested. U.S. Pat. No. 5,141,665 (Sherman) discloses a cleaning, conditioning, storing and wetting system for rigid gas permeable contact lenses. The system is described as including: (1) a cleaning, conditioning and storing solution; and (2) a separate wetting solution, wherein both solutions include a disinfectant or preservative. Lenses treated with the first solution are rinsed and then wet with the separate wetting solution prior to insertion in the eye.

Multipurpose contact lens solutions which effectively clean a contact lens, and can also be used to treat the lens immediately prior to insertion of the lens in the eye, represent the more difficult multipurpose solutions to develop. Conventional surface active agents having good cleaning activity for contact lens deposits, as well as various other components such as antimicrobial agents included as a preservative or disinfectant, tend to be irritating to the eye. Additionally, the surface active agents must not inhibit the wetting or conditioning function of the solution.

Multipurpose contact lens solutions for cleaning and wetting contact lenses have also been suggested which employ as the primary cleaning agent a surface active agent having minimal or no irritation. As an example, U.S. Pat. Nos. 3,882,036 and 3,954,644 (Krezanoski et al.) suggest compositions comprising a polyethyleneoxy-polypropyleneoxy block copolymer (also known as poloxamer) having minimal or no eye irritation as the primary cleaning agent.

U.S. Pat. No. 4,820,352 (Riedhammer et al.) suggests compositions for cleaning and conditioning contact lenses which are sufficiently nonirritating that a contact lens treated with the solution can be inserted directly in the eye. Preferred compositions employ as the primary cleaning agent a specific class of polyethyleneoxy-polypropyleneoxy block copolymer adducts of ethylene diamine (also known as poloxamine), which agents are both effective at cleaning and exhibit minimal or no eye irritation.

Although the specific Class of poloxamine surface active agents described in the Riedhammer patent provide good cleaning action for contact lens deposits and exhibit minimal eye irritation, other surface active agents exhibiting acceptable eye irritation levels generally have-a relatively low cleaning ability for contact lens deposits. Accordingly, this latter approach to minimize eye irritation frequently results in a sacrifice of good cleaning activity.

SUMMARY OF THE INVENTION

This invention provides an aqueous composition for cleaning and wetting contact lenses which comprises:

(a) a non-amine polyethyleneoxy-containing material having an HLB value of at least about 18;

(b) a surface active agent having cleaning activity for contact lens deposits; and (c) a wetting agent.

The compositions provide effective cleaning activity, and are also effective at wetting surfaces of the lens. Additionally, the compositions achieve the desired cleaning but are relatively nonirritating to the eye. According to preferred embodiments, the compositions are sufficiently nonirritating that contact lenses treated with the composition can be inserted directly in the eye, i.e., without the need to rinse the composition from the lens, or the composition can be administered directly in the eye for use as a rewetting solution.

DETAILED DESCRIPTION OF THE INVENTION

The composition of the invention is an aqueous composition which comprises:

(a) a non-amine polyethyleneoxy-containing material having an HLB value of at least about 18;

(b) a surface active agent having cleaning activity for contact lens deposits; and (c) a wetting agent.

The first component is a non-amine polyethyleneoxy-containing material having a hydrophile-lipophile balance (HLB) of at least about 18. Generally, the materials of this class are not particularly effective cleaners for contact lens deposits when employed as the primary cleaning agent. However, Applicants have found that when these materials are employed in conjunction with a surface active agent having good cleaning activity, the high-HLB materials alleviate the potential of eye irritation of the compositions attributed to components such as the surface active agent and other components. Accordingly, surface active agents which would otherwise be irritating to the eye can be employed in the compositions.

In addition to homopolymers of polyethylene glycol or polyethyleneoxy, Representative PEO-containing materials having an HLB value of at least 18 include certain polyethyleneoxy-polypropyleneoxy block copolymers, also known as poloxamers. Such materials are commercially available under the tradename Pluronic from BASF Corporation, Parsippany, N.J., USA, and include Pluronic Y108 and F127. Other suitable PEO-containing materials include ethoxylated glucose derivatives, such as methyl gluceth-20 including the product available as Glucam E-20 (Amerchol Corp., Edison, N.J., USA), and high HLB ethoxylated nonionic ethers of sorbitol or glycerol, such as products available under the tradename Ethosperse, including sorbeth-20 supplied as Ethosperse SL-20 and glycereth-26 supplied as Ethosperse G-26 (Lonza Inc., Fair Lawn, N.J., USA).

Representative PEO-containing materials are listed in Table A with HLB value and molecular weight. For comparative purposes, two PEO-containing materials which do not have an HLB value of at least about 18 (polysorbate 20 (Tween 20), and the poloxamer Pluronic P104) are included. The HLB values and molecular weight were provided by manufacturers, or calculated or estimated based on chemical structure.

TABLE A

| Material | HLB Value | Aver MW |
|---|---|---|
| Pluronic P104 | 12–18 | 5,900 |
| Tween 20 | 16.7 | 1,260 |
| Ethosperse G-26 | 18 | 1,224 |
| Glucan E-20 | >18 | 1,074 |
| Pluronic F127 | 18–23 | 12,600 |
| Pluronic F108 | >24 | 14,600 |
| Polyethylene glycol | >24 | 18,500 |

The PEO-containing materials may be employed in the compositions at about 0.001 to about 10 weight percent, preferably at about 0.001 to about 5 weight percent.

The composition further includes a surface active agent having cleaning activity for contact lens deposits. A wide variety of surface active agents are known in the art as a primary cleaning agent, including anionic, cationic, nonionic and amphoteric surface active agents.

Representative anionic surface active agents include sulfated and sulfonated surface active agents, and physiologically acceptable salts thereof, which provide good cleaning activity for lipids, proteins, and other contact lens deposits. Examples include sodium lauryl sulfate, sodium laureth sulfate (sodium salt of sulfated ethoxylated lauryl alcohol), ammonium laureth sulfate (ammonium salt of sulfated ethoxylated lauryl alcohol), sodium trideceth sulfate (sodium salt of sulfated ethoxylated tridecyl alcohol), sodium dodecylbenzene sulfonate, disodium lauryl or laureth sulfosuccinate (disodium salt of a lauryl or ethoxylated lauryl alcohol half ester of sulfosuccinic acid), disodium oleamido sulfosuccinates, and dioctyl sodium sulfosuccinate (sodium salt of the diester of a 2-ethylhexyl alcohol and sulfosuccinic acid).

Nonionic surface active agents having good cleaning activity include certain polyoxyethylene, polyoxypropylene block copolymer (poloxamer) surface active agents, including various surface active agents available under the tradename Pluronic from BASF Corp., e.g., Pluronic P104 or L64. (In contrast with the high-HLB PEO-containing materials, the poloxamers which may be employed as a primary cleaning agent in the compositions of this invention have an HLB value less than 18, generally about 12 to about 18.) Other representative nonionic surface active agents include: ethoxylated alkyl phenols, such as various surface active agents available under the tradenames Triton (Union Carbide, Tarrytown, N.Y., USA) and Igepal (Rhone-Poulenc, Cranbury, N.J., USA); polysorbates such as polysorbate 20, including the polysorbate surface active agents available under the tradename Tween (ICI Americas, Inc., Wilmington, Del., USA.); and alkyl glucosides and polyglucosides such as products available under the tradename Plantaren (Henkel Corp., Hoboken, N.J., USA).

The compositions may include a cationic surface active agent. Representative cationic surface active agents include triquaternary phosphate esters, such as various cationic surface active agents available from Mona Industries, Inc., Patterson, N.J., USA under the tradename Monaquat.

Additionally, the compositions may include an amphoteric surface active agent. Amphoteric surface active agents include fatty acid amide betaines, such as the cocoamidoalkyl betaines available under the tradename Tego-Betain (Goldschmidt Chemical Corp., Hopewell, Va., USA). Other amphoterics include imidazoline derivatives such as cocoamphopropionates available under the tradename Miranol (Rhone-Poulenc), and N-alkylamino acids such as lauramino propionic acid available under the Gradename Mirataine (Rhone-Poulenc).

Surface active agents having cleaning activity for contact lens deposits include silicone polymers having a pendant side chain containing an ionizable group. Dimethylpolysiloxanes containing a pendant side chain having a sulfonate or sulfosuccinate radical are available under the tradenames Silube WS-100 and Silube SS-154-100 (Siltech, Inc., Norcross, Ga., USA). Dimethylpolysiloxanes containing a pendant side chain having a phosphobetaine radical are available under the tradename Silicone Phosphobetaine (Siltech, Inc.), dimethylpolysiloxanes containing a pendant side chain having an amphoteric radical are available under the tradename Siltech Amphoteric (Siltech, Inc.), and dimethylpolysiloxanes substituted with propyleneglycol betaine are available under the tradename Abil B 9950 from Goldschmidt Chemical Corp., Hopewell, Va., USA. Such silicone polymers are especially compatible in the compositions of this invention, and exhibit less irritation than many conventional cleaning agents such as the above-described anionic surface active agents.

The surface active agents having cleaning activity for contact lens deposits may be employed at about 0.001 to about 5 weight percent of the composition, preferably at about 0.005 to about 2 weight percent, with about 0.01 to about 0.1 weight percent being especially preferred.

According to preferred embodiments, the composition further includes a wetting agent. Although in some cases the high-HLB PEO-containing component may contribute to the wetting ability of the composition, the inclusion of a supplemental wetting agent ensures that the composition effectively wets contact lenses treated therewith.

Representative wetting agents include: cellulosic materials such as cationic. cellulosic polymers, hydroxypropyl methylcellulose, hydroxyethyl cellulose and methylcellulose; polyvinyl alcohol; and polyvinyl pyrrolidone.

Preferred wetting agents are the cationic cellulosic materials that have the ability to associate with anionic areas on a lens surface, such as rigid gas permeable (RGP) lenses, which facilitates the material wetting and cushioning the lens surface. Other preferred wetting agents include silicone polymers having a pendant alkyleneoxide side chain, particularly products available under the tradename Dow Corning® 193 (Dow Corning, Midland, Mich., USA). For these materials, the hydrophobic silicone portion of the silicone polymers may loosely associate with the lens surface, such that the pendant alkyleneoxy side chain extends from the lens surface to enhance wettability to the lens surface. Additionally, this effect appears to provide further alleviation of irritation potential of components such as the surface active cleaning agent.

These wetting agents may be used in a wide range of concentrations, generally about 0.1 to about 10 weight percent.

The cleaning compositions include as necessary buffering agents for buffering or adjusting pH of the composition, and/or tonicity adjusting agents for adjusting the tonicity of the composition. Representative buffering agents include: alkali metal salts such as potassium or sodium carbonates, acetates, borates, phosphates, citrates and hydroxides; and weak acids such as acetic, boric and phosphoric acids. Representative tonicity adjusting agents include: sodium and potassium chloride, and those materials listed as buffering agents. The tonicity agents may be employed in an amount effective to adjust the osmotic value of the final composition to a desired value. Generally, the buffering agents and/or tonicity adjusting agents may be included up to about 10 weight percent.

According to preferred embodiments, an antimicrobial agent is included in the composition in an antimicrobially effective amount, i.e., an amount which is effective to at least inhibit growth of microorganisms in the composition. Preferably, the composition can be used to disinfect a contact lens treated therewith. Various antimicrobial agents are known in the art as useful in contact lens solutions, including: chlorhexidine (1,1'-hexamethylene-bis[5-(p-chlorophenyl) biguanide]) or water soluble salts thereof, such as chlorhexidine gluconate; polyhexamethylene biguanide (a polymer of hexamethylene biguanide, also referred to as polyaminopropyl biguanide) or water-soluble salts thereof, such as the polyhexamethylene biguanide hydrochloride available under the trade name Cosmocil CQ (ICI Americas Inc.); benzalkonium chloride; and polymeric quaternary ammonium salts. When present, the antimicrobial agent may be included at 0.00001 to about 5 weight percent, depending on the specific agent.

The compositions may further include a sequestering agent (or chelating agent) which can be present up to about 2.0 weight percent. Examples of preferred sequestering agents include ethylenediaminetetraacetic acid (EDTA) and its salts, with the disodium salt (disodium edetate) being especially preferred.

The compositions are useful for hard and soft contact lenses. Hard lenses include polymethylmethacrylate lenses and rigid gas permeable (RGP) lenses formed of a silicon or a fluorosilicon polymer. Soft contact lenses include hydrophilic hydrogel lenses.

A contact lens is cleaned by exposing the lens to the cleaning composition, preferably by immersing the lens in the composition, followed by agitation, such as by rubbing the composition on the lens surface. The lens is then rinsed to remove the composition along with contaminants. The composition may also be used to rinse the lenses, or alternately, a separate solution can be used.

When the composition is used to rinse the lens, the composition will usually adequately wet the lens surface. Due to the low irritation potential of the composition, the lens can then be inserted directly in the eye. Alternately, the cleaned lens can be subsequently treated with the composition, such as soaking the lens in the composition for sufficient time to ensure adequate wetting of the lens surface. When treating lenses with the composition including an antimicrobial agent, it is preferred to soak the lenses for sufficient time to disinfect the lenses, in which case the composition is used for cleaning, disinfecting and wetting the lens. The treated lens can then be inserted directly in the eye.

The compositions can be prepared by adding the individual components to water. A representative method follows. The salts and wetting agents, such as sodium chloride, potassium chloride, disodium edetate, cellulosic components, and/or polyvinyl alcohol (PVA), are added to premeasured, heated water with mixing. This first composition is allowed to cool, filtered, and sterilized. The sodium phosphate, potassium phosphate, PEO-containing material, the silicone polymer, the surface active agents and/or glycerin are added to premeasured water with mixing and then sterilized and filtered. The antimicrobial agents are added to the remaining amount of premeasured water, and the three compositions are combined with mixing.

The following examples illustrate various preferred embodiments.

EXAMPLES 1 TO 6

A series of solutions, represented in Tables 1A to 1D, was prepared. Amounts in the tables are parts by weight unless indicated otherwise. Examples 1 to 6 illustrate multipurpose solutions of the present invention. Three control compositions were prepared. Ctrl-1A included no surface active cleaning agent having eye irritation potential; each of Ctrl-1B and 1C similarly lacked any such cleaning agent but included a non-amine PEO-containing material having an HLB of at least about 18 (poloxamer 338, supplied as Pluronic F108, BASF). The comparative compositions included a surface active agent having cleaning activity: sodium trideceth sulfate (Sipex EST-30, Rhone-Poulenc) or a cocoamphopropionate (Miranol C2M, Rhone-Poulenc); the comparative compositions included no high-HLB PEO-containing material.

The irritation potential of the compositions was evaluated by the following procedure. A few drops of each composition was administered on the superior limbus of a subject's eye. The subject was asked to indicate occurrence of symptoms of irritation (stinging, itching or burning). These results are reported under "Symptom", wherein "P" indicates positive (subject reported irritation) and indicates negative (subject did not report irritation). Additionally, the corneas of subjects were evaluated both prior to and following administration of the composition to assess corneal staining. These results are reported under "Staining", wherein "P" indicates positive (corneal staining observed) and "N" indicates negative (no corneal staining observed).

The data demonstrate that the high-HLB PEO-containing material was useful in reducing the irritation potential of the compositions.

TABLE 1A

| Component | Cntl-1A | Cntl-1B | Cntl-1C |
|---|---|---|---|
| cationic cellulosic polymer (Polymer JR 30M. Union Carbide Corp.) | 0.05 | 0.05 | 0.05 |
| hydroxypropyl methylcellulose | 0.2 | 0.2 | 0.2 |
| sodium phosphate | 0.28 | 0.28 | 0.28 |
| potassium phosphate | 0.055 | 0.055 | 0.055 |
| sodium chloride | 0.78 | 0.78 | 0.78 |
| potassium chloride | 0.17 | 0.17 | 0.17 |
| disodium edetate | 0.05 | 0.05 | 0.05 |
| polyhexamethylene biguanide (ppm) | 10 | 10 | 10 |
| Pluronic F108 | 0 | 1 | 3 |
| deionized water (q.s. to) | 100 | 100 | 100 |
| Symptom | N | N | N |
| Staining | N | N | N |

TABLE 1B

| Component | Comp-1 | Ex-1 | Ex-2 |
|---|---|---|---|
| cationic cellulosic polymer (Polymer TR 30M) | 0.05 | 0.05 | 0.05 |
| hydroxypropyl methylcellulose | 0.2 | 0.2 | 0.2 |
| sodium phosphate | 0.28 | 0.28 | 0.28 |
| potassium phosphate | 0.055 | 0.055 | 0.055 |
| sodium chloride | 0.78 | 0.78 | 0.7 |
| potassium chloride | 0.17 | 0.17 | 0.1 |
| disodium edetate | 0.05 | 0.05 | 0.05 |
| polyhexamethylene biguanide (ppm) | 10 | 10 | 10 |
| Pluronic F108 | 0 | 1 | 3 |
| Sipex EST-30 | 0.2 | 0.2 | 0.2 |
| deionized water (q.s. to) | 100 | 100 | 100 |
| Symptom | P | P | N |
| Staining | N | N | N |

TABLE 1C

| Component | Comp-2 | Ex-3 | Ex-4 |
|---|---|---|---|
| cationic cellulosic polymer (Polymer JR 30M) | 0.05 | 0.05 | 0.05 |
| hydroxypropyl methylcellulose | 0.2 | 0.2 | 0.2 |
| sodium phosphate | 0.28 | 0.28 | 0.28 |
| potassium phosphate | 0.055 | 0.055 | 0.055 |
| sodium chloride | 0.78 | 0.78 | 0.78 |
| potassium chloride | 0.17 | 0.17 | 0.17 |
| disodium edetate | 0.05 | 0.05 | 0.05 |
| polyhexamethylene biguanide (ppm) | 10 | 10 | 10 |
| Pluronic F108 | 0 | 1 | 3 |
| Sipex EST-30 | 0.3 | 0.3 | 0.3 |
| deionized water (q.s. to) | 100 | 100 | 100 |
| Symptom | P | P | N |
| Staining | P | N | N |

TABLE 1D

| Component | Comp-3 | Ex-5 | Ex-6 |
|---|---|---|---|
| cationic cellulosic polymer (Polymer TR 30M) | 0.05 | 0.05 | 0.05 |
| hydroxypropyl methylcellulose | 0.2 | 0.2 | 0.2 |
| sodium phosphate | 0.28 | 0.28 | 0.28 |
| potassium phosphate | 0.055 | 0.055 | 0.055 |
| sodium chloride | 0.78 | 0.78 | 0.78 |
| potassium chloride | 0.17 | 0.17 | 0.17 |
| dIsodium edetate | 0.05 | 0.05 | 0.05 |
| polyhexamethylene biguanide (ppm) | 10 | 10 | 10 |
| Pluronic F108 | 0 | 1 | 3 |
| Miranol C2M | 0.3 | 0.3 | 0.3 |
| deionized water (q.s. to) | 100 | 100 | 100 |
| Symptom | P | P | N |
| staining | N | N | N |

EXAMPLES 7 TO 14

A series of solutions, represented in Tables 2A to 3D, was prepared. Examples 7 to 14 illustrate multipurpose solutions of the present invention. The comparative compositions included a surface active cleaning having eye irritation potential, but no high-HLB PEO-containing material. It is noted that Comparative Examples 5, 7 and 9, and Comparative Example 10, included a PEO-containing material, polysorbate 20 (Tween 20, ICI Americas, Inc.) or poloxamer 334 (Pluronic P104, BASF), having a lower HLB value (see Table A).

The irritation potential of the Compositions was evaluated as in the preceding examples. The data demonstrate that the non-amine PEO-containing materials having an HLB value of at least about 18 were useful in reducing the irritation potential of the compositions. In contrast, the PEO-containing material having a lower HLB value did not significantly reduce the irritation potential of the compositions.

TABLE 2A

| Component | Cntl-2A | Cntl-2B | Cntl-2C | Cntl-2D |
|---|---|---|---|---|
| cationic cellulosic polymer (Polymer TR 30M) | 0.05 | 0.05 | 0.05 | 0.05 |
| hydroxypropyl methylcellulose | 0.2 | 0.2 | 0.2 | 0.2 |
| sodium phosphate | 0.28 | 0.28 | 0.28 | 0.28 |
| potassium phosphate | 0.055 | 0.055 | 0.055 | 0.055 |
| sodibm chloride | 0.78 | 0.78 | 0.78 | 0.78 |
| potassium chloride | 0.17 | 0.17 | 0.17 | 0.17 |
| disodium edetate | 0.05 | 0.05 | 0.05 | 0.05 |
| polyhexamethylene biguanide (ppm) | 10 | 10 | 10 | 10 |
| Tween 20 | 0 | 1 | 0 | 0 |
| Pluronic F127 | 0 | 0 | 1 | 0 |
| Pluronic F108 | 0 | 0 | 0 | |
| deionized water (q.s. to) | 100 | 100 | 100 | 100 |
| Symptom | N | N | N | N |
| Staining | N | N | N | N |

TABLE 2B

| Component | Comp-4 | Comp-6 | Ex-7 | Ex-8 |
|---|---|---|---|---|
| cationic cellulosic polymer (Polymer JR 30M) | 0.05 | 0.05 | 0.05 | 0.05 |
| hydroxypropyl methylcellulose | 0.2 | 0.2 | 0.2 | 0.2 |
| sodium phosphate | 0.28 | 0.28 | 0.28 | 0.28 |
| potassium phosphate | 0.055 | 0.055 | 0.055 | 0.055 |
| sodium chloride | 0.78 | 0.78 | 0.78 | 0.78 |
| potassium chloride | 0.17 | 0.17 | 0.17 | 0.17 |
| disodium edetate | 0.05 | 0.05 | 0.05 | 0.05 |
| polyhexamethylene biguanide (ppm) | 10 | 10 | 10 | 10 |
| Sipex EST-30 | 0.1 | 0.1 | 0.1 | 0.1 |
| Standapol 124-3 (Henkel Corp.) | 0.1 | 0.1 | 0.1 | 0.1 |
| Tween 20 | 0 | 1 | 0 | 0 |
| Pluronic F127 | 0 | 0 | 1 | 0 |
| Pluronic F108 | 0 | 0 | 0 | 1 |
| deionized water (q.s. to) | 100 | 100 | 100 | 100 |
| Symptom | P | P | N | N |
| staining | P | P | N | N |

TABLE 2C

| Component | Comp-6 | Comp-7 | Ex-9 | Ex-10 |
|---|---|---|---|---|
| cationic cellulosic polymer (Polymer JR 30M) | 0.05 | 0.05 | 0.05 | 0.05 |
| hydroxypropyl methylcellulose | 0.2 | 0.2 | 0.2 | 0.2 |
| sodium phosphate | 0.28 | 0.28 | 0.28 | 0.28 |
| potassium phosphate | 0.055 | 0.055 | 0.055 | 0.055 |
| sodium chloride | 0.78 | 0.78 | 0.78 | 0.78 |
| potassium chloride | 0.17 | 0.17 | 0.17 | 0.17 |
| disodium edetate | 0.05 | 0.05 | 0.05 | 0.05 |
| polyhexamethylene biguanide (ppm) | 10 | 10 | 10 | 10 |
| Sipex EST-30 | 0.1 | 0.1 | 0.1 | 0.1 |
| Miranol C2M | 0.1 | 0.1 | 0.1 | 0.1 |
| Tween 20 | 0 | 1 | 0 | 0 |
| Pluronic F127 | 0 | 0 | 1 | 0 |
| Pluronic F108 | 0 | 0 | 0 | 1 |
| deionized water (q.s. to) | 100 | 100 | 100 | 100 |

TABLE 2C-continued

| Component | Comp-6 | Comp-7 | Ex-9 | Ex-10 |
|---|---|---|---|---|
| Symptom | P | P | N | N |
| Staining | P | P | N | N |

TABLE 3A

| Component | Cntl-3A | Cntl-3B | Cntl-3C | Cntl-3D |
|---|---|---|---|---|
| silicone glycol copolymer (193, Dow Corning) | 0.05 | 0.05 | 0.05 | 0.05 |
| sodium phosphate | 0.28 | 0.28 | 0.28 | 0.28 |
| potassium phosphate sodium chloride | 0.055 | 0.055 | 0.055 | 0.055 |
| | 0.78 | 0.78 | 0.78 | 0.78 |
| potassium chloride | 0.17 | 0.17 | 0.17 | 0.17 |
| disodium edetate | 0.05 | 0.05 | 0.05 | 0.05 |
| polyhexamethylene biguanide (ppm) | 10 | 10 | 10 | 10 |
| Tween 20 | 0 | 1 | 0 | 0 |
| Pluronic F127 | 0 | 0 | 1 | 0 |
| Pluronic F108 | 0 | 0 | 0 | 1 |
| deionized water (q.s. to) | 100 | 100 | 100 | 100 |
| Symptom | N | N | N | N |
| Staining | N | N | N | N |

TABLE 3B

| Component | Cntl-3E | Cntl-3F | Cntl-3G |
|---|---|---|---|
| silicone glycol copolymer (193, Dow Corning) | 0.05 | 0.05 | 0.05 |
| sodium phosphate | 0.28 | 0.28 | 0.28 |
| potassium phosphate | 0.055 | 0.055 | 0.055 |
| sodium chloride | 0.78 | 0.78 | 0.78 |
| potassium chloride | 0.17 | 0.17 | 0.17 |
| disodium edetate | 0.05 | 0.05 | 0.05 |
| polyhexamethylene biguanide (ppm) | 10 | 10 | 10 |
| Pluronic P104 | 1 | 0 | 0 |
| Ethosperse G-26 | 0 | 1 | 0 |
| PEG (MW aver 18,500) | 0 | 0 | 1 |
| deionized water (q.s. to) | 100 | 100 | 100 |
| Symptom | N | N | N |
| Staining | N | N | N |

TABLE 3C

| Component | Comp-8 | Comp-9 | Ex-11 | Ex-12 |
|---|---|---|---|---|
| silicone glycol copolymer (193, Dow Corning) | 0.05 | 0.05 | 0.05 | 0.05 |
| sodium phosphate | 0.28 | 0.28 | 0.28 | 0.28 |
| potassium phosphate | 0.055 | 0.055 | 0.055 | 0.055 |
| sodium chloride | 0.78 | 0.78 | 0.78 | 0.78 |
| potassiuin chloride | 0.17 | 0.17 | 0.17 | 0.17 |
| disodium edetate | 0.05 | 0.05 | 0.05 | 0.05 |
| polyhexamethylene biguanide (ppm) | 10 | 10 | 10 | 10 |
| Sipex EST-30 | 0.2 | 0.2 | 0.2 | 0.2 |
| Tween 20 | 0 | 1 | 0 | 0 |
| Pluronic F127 | 0 | 0 | 1 | 0 |
| Pluronic F108 | 0 | 0 | 0 | 1 |
| deionized water | 100 | 100 | 100 | 100 |
| Symptom | P | P | N | N |
| Staining | P | P | N | N |

TABLE 3D

| Component | Comp-10 | Ex-13 | Ex-14 |
|---|---|---|---|
| silicone glycol copolymer (193, Dow Corning) | 0.05 | 0.05 | 0.05 |
| sodium phosphate | 0.28 | 0.28 | 0.28 |
| potassium phosphate | 0.055 | 0.055 | 0.055 |
| sodium chloride | 0.78 | 0.78 | 0.78 |
| potassium chloride | 0.17 | 0.17 | 0.17 |
| disodium edetate | 0.05 | 0.05 | 0.05 |
| polyhexamethylene biguanide (ppm) | 10 | 10 | 10 |
| Sipex EST-30 | 0.2 | 0.2 | 0.2 |
| Pluronic P104 | 1 | 0 | 0 |
| Ethosperse G-26 | 0 | 1 | 0 |
| PEG (MW aver 18,500) | 0 | 0 | 1 |
| deionized water (q.s. to) | 100 | 100 | 100 |
| Symptom | P | N | N |
| Staining | P | N | N |

EXAMPLES 15 TO 41

A series of solutions of the present invention, represented in Tables 4 to 9, was prepared. The irritation potential of the compositions was evaluated as in the preceding examples.

Additionally, the cleaning efficacy of the compositions was tested. For the cleaning model, lenses were soaked overnight in a 0.01% solution of lanolin in hexane, the solvent was evaporated, and a greasy film of lipids (present in lanolin) remained on the lenses. The lenses wets then cleaned as follows: the lenses were soaked in the subject composition for 2 hours, 2 or 3 drops of the subject composition was finger rubbed on the lens for about 20 seconds, followed by rinsing with tap water for about 20 seconds. The lens was then air dried and examined under the microscope. Cleaning efficacy ratings are listed in the tables, wherein the relative ratings are based on a scale of 0 to 3: "0" designates no deposits, "1" designates trace deposits, "2" designates slight contamination and "3" designates obvious contamination.

TABLE 4

| Component | EX-15 | EX-16 | EX-17 | EX-18 | EX-19 |
|---|---|---|---|---|---|
| silicone glycol copolymer (193, Dow Corning) | 0.05 | 0.05 | 0.05 | 0.05 | 0.05 |
| sodium phosphate | 0.28 | 0.28 | 0.28 | 0.28 | 0.28 |
| potassium phosphate | 0.055 | 0.055 | 0.055 | 0.055 | 0.055 |
| sodium chloride | 0.78 | 0.78 | 0.78 | 0.78 | 0.78 |
| potassium chloride | 0.17 | 0.17 | 0.17 | 0.17 | 0.17 |
| disodium edetate | 0.05 | 0.05 | 0.05 | 0.05 | 0.05 |
| polyhexamethylene biguanide (ppm) | 10 | 10 | 10 | 10 | 10 |
| Sipex EST-30 | 0.1 | 0 | 0 | 0 | 0 |
| sodium lauroyl sarcosinate (Hamposyl L-30, W.R. Grace) | 0 | 0.1 | 0 | 0 | 0 |
| Standapol 124-3 | 0 | 0 | 0.1 | 0 | 0 |
| Sodium lauramino-propionic acid (Miratain H2C-HA, Rhone-Poulenc) | 0 | 0 | 0 | 0.1 | 0 |
| cocoamphopropionate (Miranol C2M-LV, Rhone-Poulenc) | 0 | 0 | 0 | 0 | 0.1 |
| Pluronic F108 | 1.0 | 1.0 | 1.0 | 1.0 | 1.0 |
| deionized water (q.s. to) | 100 | 100 | 100 | 100 | 100 |
| Symptom | N | N | N | N | N |
| Staining | N | N | N | N | N |
| Cleaning Rating | 0 | 0 | 1 | 0 | 1 |

TABLE 5

| Component | EX-20 | EX-21 | EX-22 | EX-23 |
|---|---|---|---|---|
| silicone glycol copolymer (193, Dow Corning) | 0.05 | 0.05 | 0.05 | 0.05 |
| sodium phosphate | 0.28 | 0.28 | 0.28 | 0.28 |
| potassium phosphate | 0.055 | 0.055 | 0.055 | 0.055 |
| sodium chloride | 0.78 | 0.78 | 0.78 | 0.78 |
| potassium chloride | 0.17 | 0.17 | 0.17 | 0.17 |
| disodium edetate | 0.05 | 0.05 | 0.05 | 0.05 |
| polyhexamethylene biguanide (ppm) | 10 | 10 | 10 | 10 |
| Monaquat PTC | 0.1 | 0 | 0 | 0 |
| Pluronic L 64 | 0 | 0.1 | 0 | 0 |
| alkyl polyglucoside (Plantaren 2000, Henkel) | 0 | 0 | 0.1 | 0 |
| Tween 80 | 0 | 0 | 0 | 0.1 |
| Pluronic F108 | 1.0 | 1.0 | 1.0 | 1.0 |
| deionized water (q.s. to) | 100 | 100 | 100 | 100 |
| Symptom | N | N | N | N |
| Staining | N | N | N | N |
| Cleaning Rating | 1 | 1 | 0 | 1 |

TABLE 6

| Component | EX-24 | EX-25 | EX-26 | EX-27 | EX-28 |
|---|---|---|---|---|---|
| silicone glycol copolymer (193, Dow Corning) | 0.05 | 0.05 | 0.05 | 0.05 | 0.05 |
| sodium phosphate | 0.28 | 0.28 | 0.28 | 0.28 | 0.28 |
| potassium phosphate | 0.055 | 0.055 | 0.055 | 0.055 | 0.055 |
| sodium chloride | 0.78 | 0.78 | 0.78 | 0.78 | 0.78 |
| potassium chloride | 0.17 | 0.17 | 0.17 | 0.17 | 0.17 |
| disodium edetate | 0.05 | 0.05 | 0.05 | 0.05 | 0.05 |
| polyhexamethylene biguanide (ppm) | 10 | 10 | 10 | 10 | 10 |
| Sipex EST-30 | 0.1 | 0 | 0 | 0 | 0 |
| Hamposyl L-30 | 0 | 0.1 | 0 | 0 | 0 |
| Standapol 124-3 | 0 | 0 | 0.1 | 0 | 0 |
| Miratain H2C-HA | 0 | 0 | 0 | 0.1 | 0 |
| Miranol C2M-LV | 0 | 0 | 0 | 0 | 0.1 |
| Glucam E-20 | 1.0 | 1.0 | 1.0 | 1.0 | 1.0 |
| deionized water (q.s. to) | 100 | 100 | 100 | 100 | 100 |
| Symptom | P | N | N | P | N |
| Staining | N | N | N | N | N |
| Cleaning Rating | 1 | 2 | 1 | 1 | 0 |

TABLE 7

| Component | EX-29 | EX-30 | EX-31 | EX-32 |
|---|---|---|---|---|
| silicone glycol copolymer (193, Dow Corning) | 0.05 | 0.05 | 0.05 | 0.05 |
| sodium phosphate | 0.28 | 0.28 | 0.28 | 0.28 |
| potassium phosphate | 0.055 | 0.055 | 0.055 | 0.055 |
| sodium chloride | 0.78 | 0.78 | 0.78 | 0.78 |
| potassium chloride | 0.17 | 0.17 | 0.17 | 0.17 |
| disodium edetate | 0.05 | 0.05 | 0.05 | 0.05 |
| polyhexamethylene biguanide (ppm) | 10 | 10 | 10 | 10 |
| Monaquat PTC | 0.1 | 0 | 0 | 0 |
| Pluronic L 64 | 0 | 0.1 | 0 | 0 |
| Plantaren 2000 | 0 | 0 | 0.1 | 0 |
| Tween 80 | 0 | 0 | 0 | 0.1 |
| Glucam E-20 | 1.0 | 1.0 | 1.0 | 1.0 |
| deionized water (q.s. to) | 100 | 100 | 100 | 100 |
| Symptom | N | N | N | N |

TABLE 7-continued

| Component | EX-29 | EX-30 | EX-31 | EX-32 |
|---|---|---|---|---|
| Staining | N | N | N | N |
| Cleaning Rating | 1 | 1 | 1 | 2 |

TABLE 8

| Component | EX-33 | EX-34 | EX-35 | EX-36 | EX-37 |
|---|---|---|---|---|---|
| cationic cellulosic polymer (Polymer JR 30M) | 0.05 | 0.05 | 0.05 | 0.05 | 0.05 |
| sodium phosphate | 0.28 | 0.28 | 0.28 | 0.28 | 0.28 |
| potassium phosphate | 0.055 | 0.055 | 0.055 | 0.055 | 0.055 |
| sodium chloride | 0.78 | 0.78 | 0.78 | 0.78 | 0.78 |
| potassium chloride | 0.17 | 0.17 | 0.17 | 0.17 | 0.17 |
| disodium edetate | 0.05 | 0.05 | 0.05 | 0.05 | 0.05 |
| polyhexamethylene biguanide (ppm) | 10 | 10 | 10 | 10 | 10 |
| Sipex EST-30 | 0.1 | 0 | 0 | 0 | 0 |
| Hamposyl L-30 | 0 | 0.1 | 0 | 0 | 0 |
| Standapol 124-3 | 0 | 0 | 0.1 | 0 | 0 |
| Miratain H2C-HA | 0 | 0 | 0 | 0.1 | 0 |
| Miranol C2M-LV | 0 | 0 | 0 | 0 | 0.1 |
| PEG (MW aver. 18,500) | 1.0 | 1.0 | 1.0 | 1.0 | 1.0 |
| deionized water (q.s. to) | 100 | 100 | 100 | 100 | 100 |
| Symptom | N | P | N | N | N |
| Staining | N | P | N | N | N |
| Cleaning Rating | 0 | 0 | 1 | 0 | 1 |

TABLE 9

| Component | EX-38 | EX-39 | EX-40 | EX-41 |
|---|---|---|---|---|
| cationic cellulosic polymer (Polymer JR 30M) | 0.05 | 0.05 | 0.05 | 0.05 |
| sodium phosphate | 0.28 | 0.28 | 0.28 | 0.28 |
| potassium phosphate | 0.055 | 0.055 | 0.055 | 0.055 |
| sodium chloride | 0.78 | 0.78 | 0.78 | 0.78 |
| potassium chloride | 0.17 | 0.17 | 0.17 | 0.17 |
| disodium edetate | 0.05 | 0.05 | 0.05 | 0.05 |
| polyhexamethylene biguanide (ppm) | 10 | 10 | 10 | 10 |
| Monaquat PTC | 0.1 | 0 | 0 | 0 |
| Pluronic L 64 | 0 | 0.1 | 0 | 0 |
| Plantaren 2000 | 0 | 0 | 0.1 | 0 |
| Tween 80 | 0 | 0 | 0 | 0.1 |
| polyethylene glycol (average MW about 18,500) | 1.0 | 1.0 | 1.0 | 1.0 |
| deionized water (q.s. to) | 100 | 100 | 100 | 100 |
| Symptom | N | N | N | N |
| Staining | N | N | N | N |
| Cleaning Rating | 1 | 1 | 1 | 0 |

EXAMPLES 42 TO 71

A series of solutions of the present invention, represented in Tables 10 to 15, was prepared, and the irritation potential of the compositions was evaluated as in the preceding examples.

Additionally, the cleaning efficacy of the compositions was-tested on worn lenses. Rigid gas permeable (RGP) lenses were worn for 15 to 18 hours, left dry overnight, and cleaned the next day by finger rubbing 2 or 3 drops of the subject composition for about 20 seconds, rinsing under tap water for about 20 seconds, and air drying the rinsed lens. Subsequently, the cleaned lens was examined under microscope. The cleaning efficacy scale corresponds to that in the preceding examples.

TABLE 10

| Component | EX-42 | EX-43 | EX-44 | EX-45 | EX-46 |
|---|---|---|---|---|---|
| hydroxypropyl methylcellulose | 0.5 | 0.5 | 0.5 | 0.5 | 0.5 |
| PVA (Airvol 107) | 0.3 | 0.3 | 0.3 | 0.3 | 0.3 |
| silicone glycol copolymer (193, Dow Corning) | 0.05 | 0.05 | 0.05 | 0.05 | 0.05 |
| sodium phosphate | 0.28 | 0.28 | 0.28 | 0.28 | 0.28 |
| potassium phosphate | 0.055 | 0.055 | 0.055 | 0.055 | 0.055 |
| sodium chloride | 0.78 | 0.78 | 0.78 | 0.78 | 0.78 |
| potassium chloride | 0.17 | 0.17 | 0.17 | 0.17 | 0.17 |
| disodium edetate | 0.05 | 0.05 | 0.05 | 0.05 | 0.05 |
| polyhexamethylene biguanide (ppm) | 10 | 10 | 10 | 10 | 10 |
| Sipex EST-30 | 0.1 | 0 | 0 | 0 | 0 |
| Hamposyl L-30 | 0 | 0.1 | 0 | 0 | 0 |
| Standapol 124-3 | 0 | 0 | 0.1 | 0 | 0 |
| cocamidopropyl betaine (Tego-Betaine L7, Goldschmidt) | 0 | 0 | 0 | 0.1 | 0 |
| Miranol C2M-LV | 0 | 0 | 0 | 0 | 0.1 |
| Pluronic F108 (MW aver. 18,500) | 1.0 | 1.0 | 1.0 | 1.0 | 1.0 |
| deionized water (q.s. to) | 100 | 100 | 100 | 100 | 100 |
| Symptom | N | N | N | N | N |
| Staining | N | N | N | N | N |
| Cleaning Rating | 0 | 0 | 0 | 0 | 0 |

TABLE 11

| Component | EX-47 | EX-48 | EX-49 | EX-50 | EX-51 |
|---|---|---|---|---|---|
| hydroxypropyl methylcellulose | 0.5 | 0.5 | 0.5 | 0.5 | 0.5 |
| PVA (Airvol 107) | 0.3 | 0.3 | 0.3 | 0.3 | 0.3 |
| silicone glycol copolymer (193, Dow Corning) | 0.05 | 0.05 | 0.05 | 0.05 | 0.05 |
| sodium phosphate | 0.28 | 0.28 | 0.28 | 0.28 | 0.28 |
| potassium phosphate | 0.055 | 0.055 | 0.055 | 0.055 | 0.055 |
| sodium chloride | 0.78 | 0.78 | 0.78 | 0.78 | 0.78 |
| potassium chloride | 0.17 | 0.17 | 0.17 | 0.17 | 0.17 |
| disodium edetate | 0.05 | 0.05 | 0.05 | 0.05 | 0.05 |
| polyhexamethylene biguanide (ppm) | 10 | 10 | 10 | 10 | 10 |
| Monaquat PTC | 0.1 | 0 | 0 | 0 | 0 |
| amphoteric polysiloxane (Silicone Amphoteric, Siltech) | 0 | 0.1 | 0 | 0 | 0 |
| Pluronic L 64 | 0 | 0 | 0.1 | 0 | 0 |
| Plantaren 2000 | 0 | 0 | 0 | 0.1 | 0 |
| Tween 80 | 0 | 0 | 0 | 0 | 0.1 |
| Pluronic F108 (MW aver. 18,500) | 1.0 | 1.0 | 1.0 | 1.0 | 1.0 |
| deionized water (q.s. to) | 100 | 100 | 100 | 100 | 100 |
| Symptom | N | N | N | N | N |
| Staining | N | N | N | N | N |
| Cleaning Rating | 0 | 0 | 0 | 0 | 0 |

TABLE 12

| Component | EX-52 | EX-53 | EX-54 | EX-55 | EX-56 |
|---|---|---|---|---|---|
| hydroxypropyl methylcellulose | 0.5 | 0.5 | 0.5 | 0.5 | 0.5 |
| PVA (Airvol 107) | 0.3 | 0.3 | 0.3 | 0.3 | 0.3 |
| silicone glycol copolymer | 0.05 | 0.05 | 0.05 | 0.05 | 0.05 |

TABLE 12-continued

| Component | EX-52 | EX-53 | EX-54 | EX-55 | EX-56 |
|---|---|---|---|---|---|
| (193, Dow Corning) | | | | | |
| sodium phosphate | 0.28 | 0.28 | 0.28 | 0.28 | 0.28 |
| potassium phosphate | 0.055 | 0.055 | 0.055 | 0.055 | 0.055 |
| sodium chloride | 0.78 | 0.78 | 0.78 | 0.78 | 0.78 |
| potassium chloride | 0.17 | 0.17 | 0.17 | 0.17 | 0.17 |
| disodium edetate | 0.05 | 0.05 | 0.05 | 0.05 | 0.05 |
| polyhexamethylene biguanide (ppm) | 10 | 10 | 10 | 10 | 10 |
| Sipex EST-30 | 0.1 | 0 | 0 | 0 | 0 |
| Hamposyl L-30 | 0 | 0.1 | 0 | 0 | 0 |
| Standapol 124-3 | 0 | 0 | 0.1 | 0 | 0 |
| Tego-Betaine L7 | 0 | 0 | 0 | 0.1 | 0 |
| Miranol C2M-LV | 0 | 0 | 0 | 0 | 0.1 |
| Glucam E-20 | 1.0 | 1.0 | 1.0 | 1.0 | 1.0 |
| deionized water (q.s. to) | 100 | 100 | 100 | 100 | 100 |
| Symptom | N | N | N | N | N |
| Staining | N | N | N | N | N |
| Cleaning Rating | 0 | 0 | 0 | 0 | 0 |

TABLE 13

| Component | EX-57 | EX-58 | EX-59 | EX-60 | EX-61 |
|---|---|---|---|---|---|
| hydroxypropyl methylcellulose | 0.5 | 0.5 | 0.5 | 0.5 | 0.5 |
| PVA (Airvol 107) | 0.3 | 0.3 | 0.3 | 0.3 | 0.3 |
| silicone glycol copolymer (193, Dow Corning) | 0.05 | 0.05 | 0.05 | 0.05 | 0.05 |
| sodium phosphate | 0.28 | 0.28 | 0.28 | 0.28 | 0.28 |
| potassium phosphate | 0.055 | 0.055 | 0.055 | 0.055 | 0.055 |
| sodium chloride | 0.78 | 0.78 | 0.78 | 0.78 | 0.78 |
| potassium chloride | 0.17 | 0.17 | 0.17 | 0.17 | 0.17 |
| disodium edetate | 0.05 | 0.05 | 0.05 | 0.05 | 0.05 |
| polyhexamethylene biguanide (ppm) | 10 | 10 | 10 | 10 | 10 |
| Monaquat PTC | 0.1 | 0 | 0 | 0 | 0 |
| Silicone Amphoteric | 0 | 0.1 | 0 | 0 | 0 |
| Pluronic L 64 | 0 | 0 | 0.1 | 0 | 0 |
| Plantaren 2000 | 0 | 0 | 0 | 0.1 | 0 |
| Tween 80 | 0 | 0 | 0 | 0 | 0.1 |
| Glucam E-20 | 1.0 | 1.0 | 1.0 | 1.0 | 1.0 |
| deionized water | 100 | 100 | 100 | 100 | 100 |
| Symptom | N | N | N | N | N |
| Staining | N | N | N | N | N |
| Cleaning Rating | 1 | 0 | 0 | 0 | 0 |

TABLE 14

| Component | EX-62 | EX-63 | EX-64 | EX-65 | EX-66 |
|---|---|---|---|---|---|
| hydroxypropyl methylcellulose | 0.5 | 0.5 | 0.5 | 0.5 | 0.5 |
| PVA (Airvol 107) | 0.3 | 0.3 | 0.3 | 0.3 | 0.3 |
| silicone glycol copolymer (193, Dow Corning) | 0.05 | 0.05 | 0.05 | 0.05 | 0.05 |
| sodium phosphate | 0.28 | 0.28 | 0.28 | 0.28 | 0.28 |
| potassium phosphate | 0.055 | 0.055 | 0.055 | 0.055 | 0.055 |
| sodium chloride | 0.78 | 0.78 | 0.78 | 0.78 | 0.78 |
| potassium chloride | 0.17 | 0.17 | 0.17 | 0.17 | 0.17 |
| disodium edetate | 0.05 | 0.05 | 0.05 | 0.05 | 0.05 |
| polyhexamethylene biguanide (ppm) | 10 | 10 | 10 | 10 | 10 |
| Sipex EST-30 | 0.1 | 0 | 0 | 0 | 0 |
| Hamposyl L-30 | 0 | 0.1 | 0 | 0 | 0 |
| Standapol 124-3 | 0 | 0 | 0.1 | 0 | 0 |
| Tego-Betaine L7 | 0 | 0 | 0 | 0.1 | 0 |
| Miranol C2M-LV | 0 | 0 | 0 | 0 | 0.1 |
| Glucam E-20 | 1.0 | 1.0 | 1.0 | 1.0 | 1.0 |

TABLE 14-continued

| Component | EX-62 | EX-63 | EX-64 | EX-65 | EX-66 |
|---|---|---|---|---|---|
| deionized water (q.s. to) | 100 | 100 | 100 | 100 | 100 |
| Symptom | N | N | N | N | N |
| Staining | N | N | N | N | N |
| Cleaning Rating | 0 | 0 | 0 | 0 | 0 |

TABLE 15

| Component | EX-67 | EX-68 | EX-69 | EX-70 | EX-71 |
|---|---|---|---|---|---|
| hydroxypropyl methylcellulose | 0.5 | 0.5 | 0.5 | 0.5 | 0.5 |
| PVA (Airvol 107) | 0.3 | 0.3 | 0.3 | 0.3 | 0.3 |
| silicone glycol copolymer (193, Dow Corning) | 0.05 | 0.05 | 0.05 | 0.05 | 0.05 |
| sodium phosphate | 0.28 | 0.28 | 0.28 | 0.28 | 0.28 |
| potassium phosphate | 0.055 | 0.055 | 0.055 | 0.055 | 0.055 |
| sodium chloride | 0.78 | 0.78 | 0.78 | 0.78 | 0.78 |
| potassium chloride | 0.17 | 0.17 | 0.17 | 0.17 | 0.17 |
| disodium edetate | 0.05 | 0.05 | 0.05 | 0.05 | 0.05 |
| polyhexamethylene biguanide (ppm) | 10 | 10 | 10 | 10 | 10 |
| Monaquat PTC | 0.1 | 0 | 0 | 0 | 0 |
| Silicone Amphoteric | 0 | 0.1 | 0 | 0 | 0 |
| Pluronic L 64 | 0 | 0 | 0.1 | 0 | 0 |
| Plantaren 2000 | 0 | 0 | 0 | 0.1 | 0 |
| Tween 80 | 0 | 0 | 0 | 0 | 0.1 |
| PEG (MW aver. 18,500) | 1.0 | 1.0 | 1.0 | 1.0 | 1.0 |
| deionized water | 100 | 100 | 100 | 100 | 100 |
| Symptom | N | N | N | N | N |
| Staining | N | N | N | N | N |
| Cleaning Rating | 0 | 0 | 0 | 0 | 0 |

Additional examples of preferred multipurpose compositions suitable for cleaning and wetting contact lenses are given in Table 16.

TABLE 16

| Component | EX 72 | EX 73 | EX 74 |
|---|---|---|---|
| sodium chloride | 0.70 | 0.78 | 0.70 |
| potassium chloride | 0.040 | 0.17 | 0.040 |
| disodium edetate | 0.050 | 0.050 | 0.050 |
| hydroxypropyl methylcellulose | 0.55 | 0.60 | 0.60 |
| sodium phosphate | 0.55 | 0.28 | 0.55 |
| potassium phosphate | 0.11 | 0.55 | 0.11 |
| Glucam E-20 | 0.10 | 0.10 | 0.10 |
| alkoxylated silicone polymer (193, Dow Corning) | 0.015 | 0.015 | 0.015 |
| Tween-20 | 0.025 | 0.020 | 0.020 |
| Tego-Betaine L7 (30%) | 0.010 | 0.010 | 0.010 |
| polyhexamethylene biguanide | 0.0005 | 0.0005 | 0.0005 |
| chlorhexidine gluconate | 0.0033 | 0.0033 | 0.0033 |
| Deionized Water (q.s. to) | 100 | 100 | 100 |
| pH | 7.4 | 7.3 | 7.3 |

TABLE 16-continued

| Component | EX 72 | EX 73 | EX 74 |
|---|---|---|---|
| Viscosity (cp at 25° C.) | 30.6 | 34.6 | 33.4 |
| Osmolality (mOsm/kg water) | 363 | 351 | 341 |

Although certain preferred embodiments have been described, it is understood that the invention is not limited thereto and modifications and variations would be evident to a person of ordinary skill in the art.

We claim:

1. A method of cleaning and wetting a contact lens comprising exposing said contact lens to an aqueous composition comprising (i) a non-amine polyethyleneoxy-containing compound having an HLB value of at least about 18; (ii) a surface active agent having cleaning activity for contact lens deposits; other than the compound of (i) and (iii) a wetting agent.

2. The method of claim 1, wherein the polyethyleneoxy-containing compound is a polyethyleneoxy-polypropyleneoxy block copolymer having an HLB value of at least about 18.

3. The method of claim 1, wherein the polyethyleneoxy-containing compound is an ethoxylated glucose derivative having an HLB value of at least about 18.

4. The method of claim 1, wherein the polyethyleneoxy-containing compound is an ethoxylated ether of sorbitol having an HLB value of at least about 18.

5. A method of cleaning and wetting a contact lens comprising:

(a) exposing said contact lens to an aqueous composition comprising (i) a non-amine polyethyleneoxy-containing compound having an HLB value of at least about 18; and (ii) a surface active agent having cleaning activity for contact lens deposits, other than the compound to remove contaminants thereof; and subsequently, (b) treating the contact lens with said composition to wet the surface of the contact lens for insertion in the eye.

6. The method of claim 5, further comprising inserting the treated contact lens directly in the eye.

7. A method of cleaning, disinfecting and wetting a contact lens comprising:

(a) exposing said contact lens to an aqueous composition comprising (i) a non-amine polyethyleneoxy-containing compound having an HLB value of at least about 18; (ii) a surface active agent having cleaning activity for contact lens deposits; other than the compound and (iii) an antimicrobially effective amount of an antimicrobial agent, and rinsing said contact lens, to remove contaminants thereon; and subsequently, (b) treating the contact lens with said composition for sufficient time to disinfect the contact lens and to wet the surface thereof for insertion in the eye.

* * * * *

UNITED STATES PATENT AND TRADEMARK OFFICE

CERTIFICATE OF CORRECTION

PATENT NO. : 5,604,189

DATED : February 18, 1997

INVENTOR(S) : Hong J. Zhang, et. al.

It is certified that error appears in the above-identified patent and that said Letters Patent is hereby corrected as shown below:

In Column 16, line 39, after "compound", insert – of (i) --

In Column 16, line 51, after "compound" insert – of (i) --

Signed and Sealed this

Thirtieth Day of June, 1998

*Attest:*

Bruce Lehman

BRUCE LEHMAN

*Attesting Officer*

*Commissioner of Patents and Trademarks*